US012721440B2

(12) United States Patent
Chen et al.

(10) Patent No.: US 12,721,440 B2
(45) Date of Patent: Sep. 1, 2026

(54) FOLDABLE RECLINER

(71) Applicant: Changzhou Qiaoyu Travel Products Co., Ltd., Changzhou (CN)

(72) Inventors: Libin Chen, Changzhou (CN); Qinglei Kong, Changzhou (CN); Xingyi Cai, Changzhou (CN)

(73) Assignee: Changzhou Qiaoyu Travel Products Co., Ltd., Changzhou (CN)

( * ) Notice: Subject to any disclaimer, the term of this patent is extended or adjusted under 35 U.S.C. 154(b) by 124 days.

(21) Appl. No.: 18/765,009

(22) Filed: Jul. 5, 2024

(65) Prior Publication Data

US 2025/0031850 A1 Jan. 30, 2025

(30) Foreign Application Priority Data

Jul. 28, 2023 (CN) ..... 202322023857.2

(51) Int. Cl.
*A47C 1/026* (2006.01)
*A47C 4/28* (2006.01)
*A47C 17/16* (2006.01)

(52) U.S. Cl.
CPC ..... *A47C 1/026* (2013.01); *A47C 4/28* (2013.01); *A47C 17/162* (2013.01)

(58) Field of Classification Search
CPC ..... A47C 17/162; A47C 1/143; A47C 1/026; A47C 4/28; A47C 4/36; A47C 4/46; A47C 1/0265
USPC ..... 297/354.13, 31, 37; 403/61, 80
See application file for complete search history.

(56) References Cited

U.S. PATENT DOCUMENTS 6,502,899 B2 * 1/2003 Tseng ..... A47C 7/54 297/39
8,197,000 B1 * 6/2012 Cohen ..... A47C 7/622 297/188.04
2024/0197081 A1 * 6/2024 Delorme ..... A47D 1/02

FOREIGN PATENT DOCUMENTS

CN 210290476 U * 4/2020

* cited by examiner

*Primary Examiner* — Milton Nelson, Jr.
(74) *Attorney, Agent, or Firm* — Birchwood IP

(57) ABSTRACT

The present invention provides a foldable recliner, comprising a ground supporting component and unfolding components, wherein the unfolding components are fixedly connected to a backrest, and first guide blind holes and second guide blind holes are formed in the unfolding components; when the backrest is in a sitting posture state, the ground supporting component is inserted into the first guide blind holes, and a height of the ground supporting component is greater than that of the backrest; and when the backrest is in a lying posture state, the ground supporting component is inserted into the second guide blind holes, such that the ground supporting component is in contact with the ground to support the backrest.

6 Claims, 10 Drawing Sheets

FOLDABLE RECLINER

CROSS-REFERENCE TO RELATED APPLICATIONS

This is a U. Satent application which claims the priority and benefit of Chinese Patent Application Number 202322023857.2, filed on Jul. 28, 2023, the disclosure of which is incorporated herein by reference in its entirety.

TECHNICAL FIELD

The present invention relates to a recliner, in particular to a foldable recliner.

BACKGROUND ART

A recliner is a sitting tool commonly used in daily life and generally includes a backrest, a seat surface and armrests. In order to pursue comfort, people will lean the back on the backrest of the recliner while sitting on the recliner. Due to different heights of people, taller people often find that the backrest of the recliner is not high enough when using the recliner, such that the head will be suspended on the backrest when using the recliner, and comfort and user experience will be greatly reduced. In addition, a user can adjust an inclination angle of the backrest of the recliner from a sitting posture to a lying posture. However, when the inclination angle of the backrest is increased, a suspended portion of the backrest is increased, thereby reducing the stability of the recliner and leading to falling and other situations of the user who uses the recliner to take a rest.

SUMMARY OF THE INVENTION

Technical problems to be solved by the present invention are as follows. In order to solve the problems that a backrest of a recliner is not high enough and the stability of the recliner is reduced when an angle of the backrest is increased, the present invention provides a foldable recliner to solve the above problems.

A technical solution adopted by the present invention to solve the technical problems is: a foldable recliner, comprising a supporting assembly and a backrest, wherein the backrest is hinged to the supporting assembly through first rotating shafts, and the backrest can be rotated between a sitting posture state and a lying posture state relative to the supporting assembly; further comprising a ground supporting component and unfolding components, wherein the unfolding components are fixedly connected to the backrest, and first guide blind holes and second guide blind holes are formed in the unfolding components; when the backrest is in the sitting posture state, the ground supporting component is inserted into the first guide blind holes, and a height of the ground supporting component is greater than that of the backrest; and when the backrest is in the lying posture state, the ground supporting component is inserted into the second guide blind holes, such that the ground supporting component is in contact with the ground to support the backrest.

As a preference, the backrest comprises backrest rods, two first guide grooves that are in mirror symmetry are formed on two side surfaces of the unfolding components along an extension direction of the first guide blind holes, two second guide grooves that are in mirror symmetry are formed on two side surfaces of the unfolding components along an extension direction of the second guide blind holes, the first guide grooves and the second guide grooves are distributed in an intersected mode, and terminal ends of the ground supporting component are connected to the first guide grooves and the second guide grooves that are distributed in an intersected mode through connecting pins, and can move along a guide direction of the first guide grooves or the second guide grooves.

As a preference, the supporting assembly comprises first supporting legs, second supporting legs, a supporting frame and a reinforcing beam, upper ends of the first supporting legs are pivotally connected to upper ends of the second supporting legs, first hinge members are hinged to the second supporting legs, U-shaped connecting sheets are fixed on a rear end of the supporting frame, end portions of the backrest rods are embedded into opening portions of the U-shaped connecting sheets and hinged to the U-shaped connecting sheets and the first hinge members through the first rotating shafts, the supporting frame is pivotally connected to the first supporting legs, and two ends of the reinforcing beam are fixedly connected to the rear end of the supporting frame.

As a preference, the foldable recliner further comprises armrests, wherein rear ends of the armrests are hinged to the backrest rods, lower ends of the armrests are provided with two hanging portions, guide grooves are formed on the hanging portions, groove walls of the guide grooves are provided with a plurality of hooks, pivot joints of the upper ends of the first supporting legs and the upper ends of the second supporting legs are fixedly connected with connecting shafts, two ends of the connecting shafts are sleeved in the two guide grooves, respectively, and by moving the connecting shafts in the guide grooves, the different hooks are hung on the connecting shafts.

As a preference, the supporting assembly comprises first supporting legs, second supporting legs, a supporting frame and a reinforcing beam, upper ends of the first supporting legs are pivotally connected to upper ends of the second supporting legs, first hinge members are hinged to the second supporting legs, U-shaped connecting sheets are fixed on the supporting frame, the first hinge members are hinged to the supporting frame through the first rotating shafts, lower portions of the backrest rods are embedded into opening portions of the U-shaped connecting sheets and hinged to the U-shaped connecting sheets through second rotating shafts, the supporting frame is hinged to the first supporting legs, and two ends of the reinforcing beam are connected to the first supporting legs.

As a preference, the foldable recliner further comprises armrests, wherein rear ends of the armrests are hinged to the backrest rods, lower ends of the armrests are provided with hanging portions, guide grooves are formed on the hanging portions, groove walls of the guide grooves are provided with a plurality of hooks, gaps are remained between the first supporting legs and the second supporting legs when the first supporting legs are pivotally connected to the second supporting legs, pivot shafts between the first supporting legs and the second supporting legs pass through the guide grooves, and by moving the pivot shafts in the guide grooves, the different hooks are hung on the pivot shafts.

Beneficial effects of the present invention are as follows. When the ground supporting component of the foldable recliner is inserted into the first guide blind holes, the ground supporting component is equivalent to an extension of the backrest at this time, and the height of the backrest is increased. When the ground supporting component is inserted into the second guide blind holes, the backrest of the recliner is adjusted backward to be in the lying posture state at this time, and the ground supporting component can be supported on the ground, such that the recliner is more stable to use.

BRIEF DESCRIPTION OF THE DRAWINGS

The present invention will be further explained below in conjunction with attached drawings and embodiments.

Figure 1:
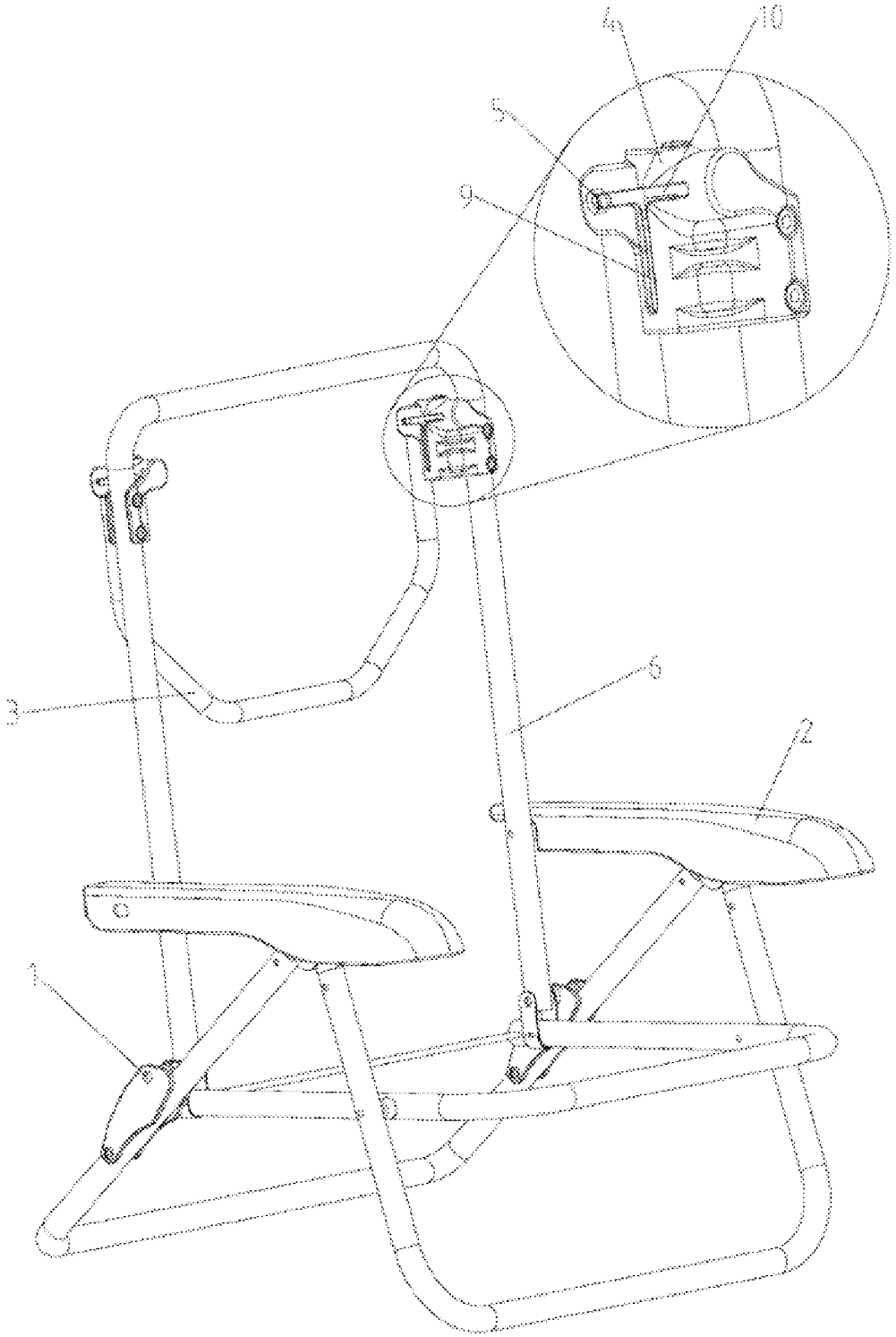
FIG. 1 is a structural schematic diagram of a foldable recliner of the present invention when a ground supporting component is folded in Embodiment.
Figure 2:
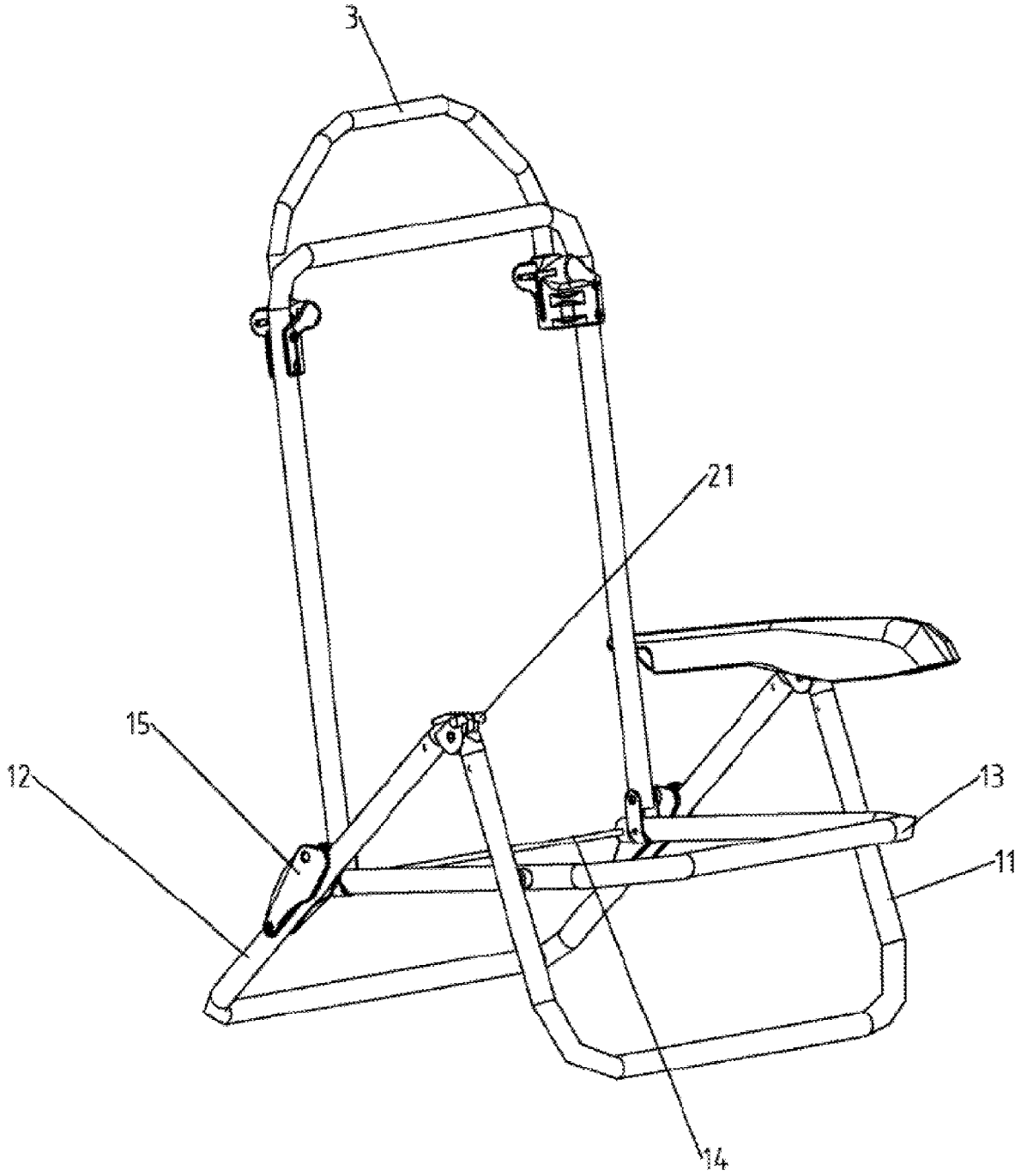
FIG. 2 is a structural schematic diagram of the foldable recliner of the present invention when one of armrests is hidden in Embodiment 1.
Figure 3:
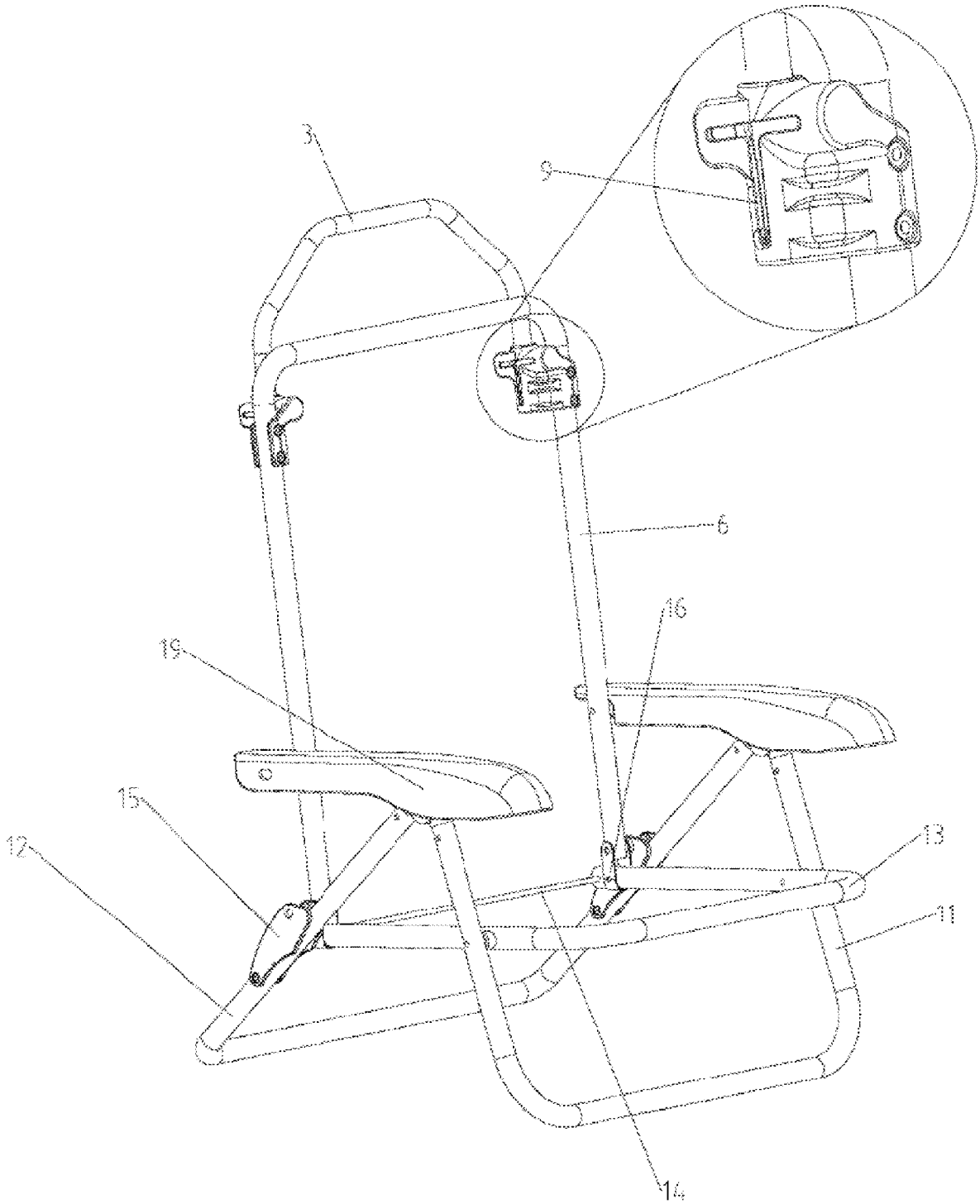
FIG. 3 is a structural schematic diagram of the foldable recliner of the present invention when a backrest is in a sitting posture state in Embodiment 1.
Figure 4:
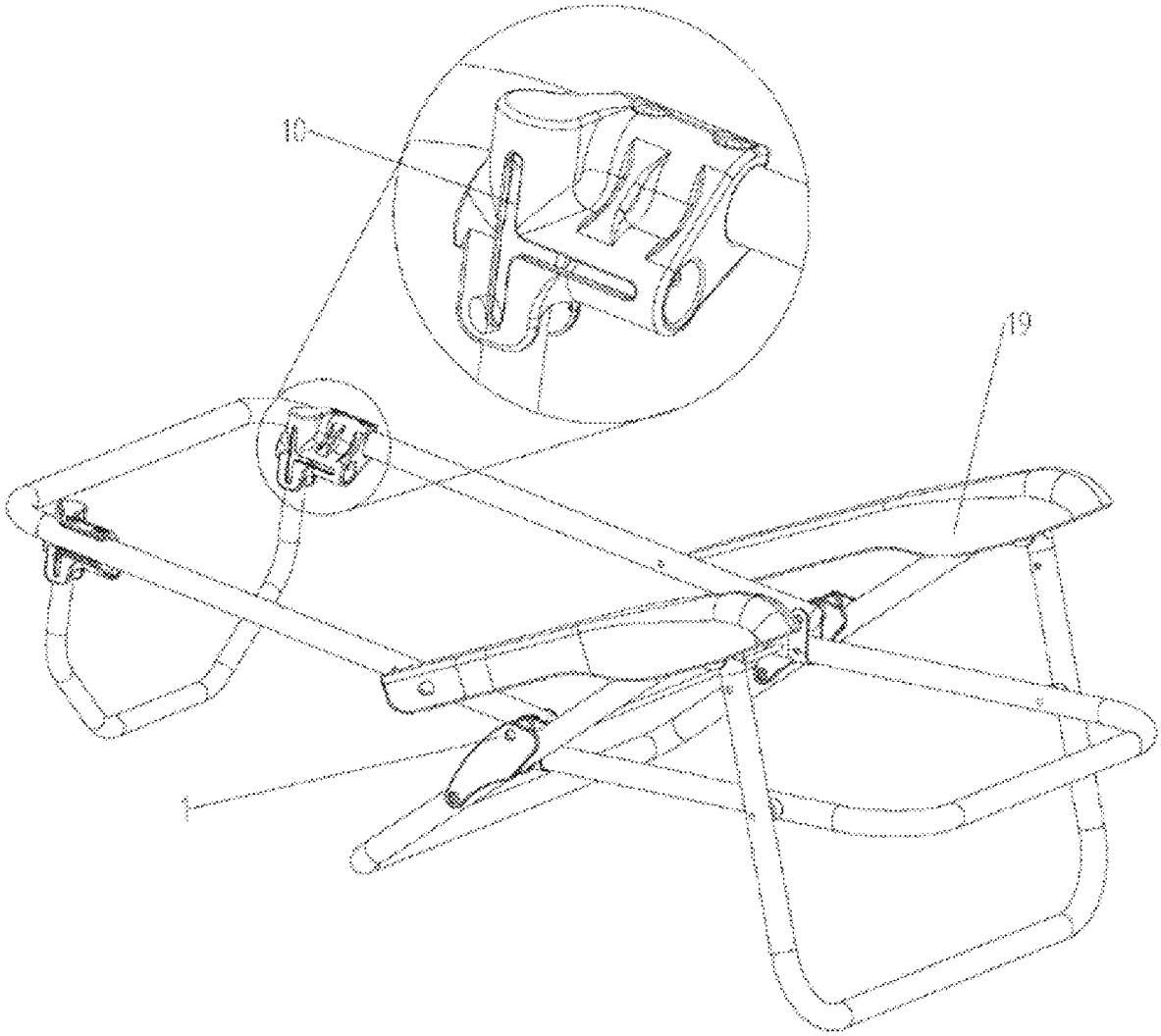
FIG. 4 is a structural schematic diagram of the foldable recliner of the present invention when the backrest is in a lying posture state in Embodiment 1.
Figure 5:
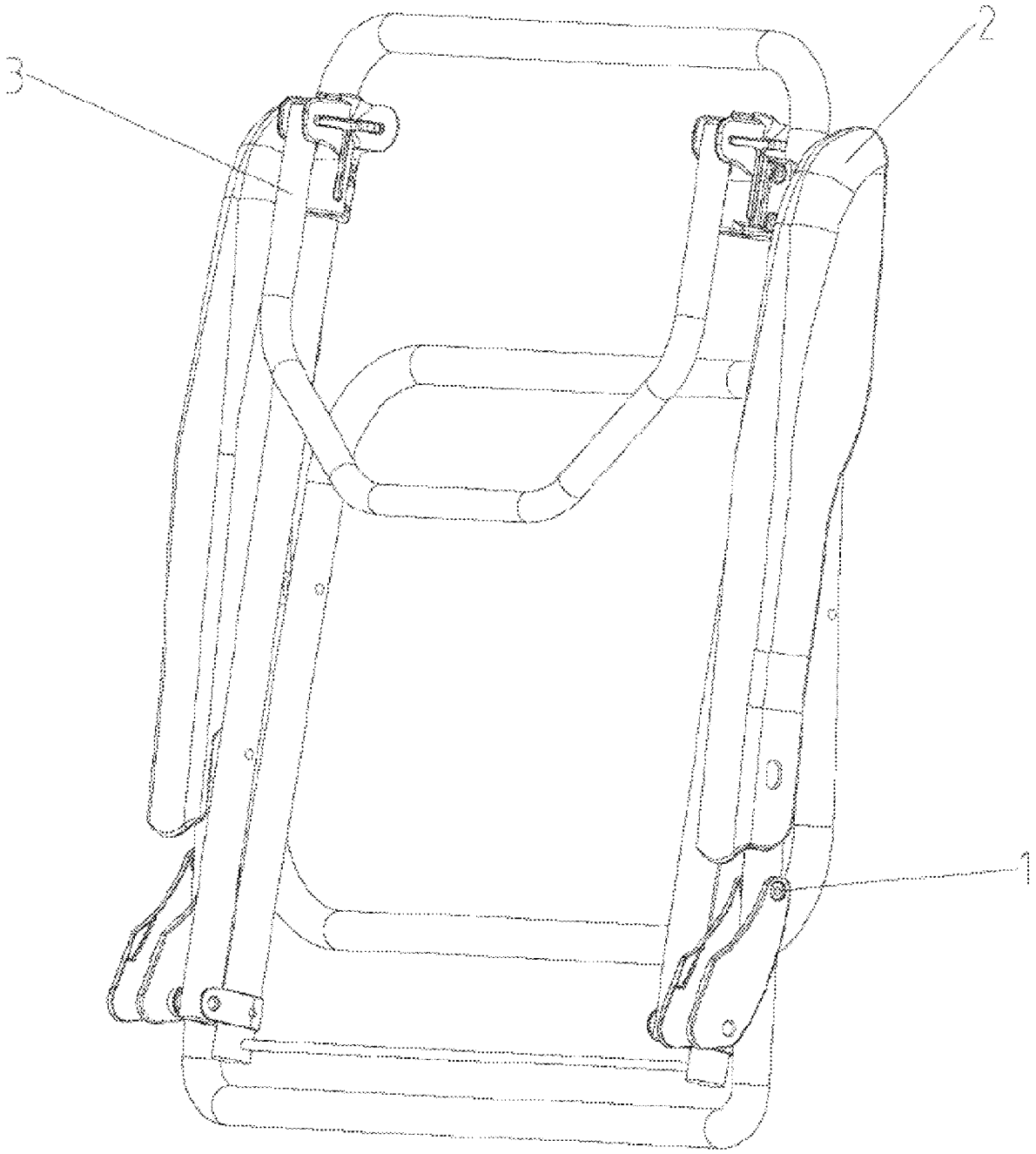
FIG. 5 is a folded structural schematic diagram of the foldable recliner of the present invention in Embodiment 1.

Reference numerals in the figures are as follows: 1, first rotating shaft; 2, armrest; 3, ground supporting component; 4, unfolding component; 5, connecting pin; 6, backrest rod; 9, first guide groove; 10, second guide groove; 11, first supporting leg; 12, second supporting leg; 13, supporting frame; 14, reinforcing beam; 15, first hinge member; 16, U-shaped connecting sheet; 17, second rotating shaft; 18, hanging portion; 19, protective cover; 20, hook; 21, connecting shaft; 22, first guide blind hole; 23, second guide blind hole.

DETAILED DESCRIPTION OF EMBODIMENTS

The embodiments of the present invention are described in detail below, and examples of the embodiments are illustrated in the drawings, in which same or similar reference numerals throughout represent same or similar elements or elements with same or similar functions. The embodiments described below with reference to the drawings are exemplary, which are only used to explain the present invention and cannot be understood as limiting the present invention.

In the description of the present invention, it should be understood that orientation or position relationships indicated by terms, such as "center", "longitudinal", "transverse", "length", "width", "thickness", "up", "down", "front", "rear", "left", "right", "vertical", "horizontal", "top", "bottom", "inside", "outside", "axial", "radial", "circumferential", etc., are based on orientation or position relationships shown in the attached drawings and are only to facilitate the description of the present invention and simplify the description, rather than to indicate or imply that a device or an element referred to needs to have a specific orientation or be constructed and operated in a specific orientation, and therefore should not be understood as limiting the present invention.

In addition, terms, such as "first" and "second", are only used to describe a purpose and shall not be understood as indicating or implying relative importance. In the description of the present invention, it should be noted that, unless otherwise clearly specified and limited, the term "connect" or "connection" should be understood in a broad sense, for example, may be fixed connection, and may also be detachable connection, or integral connection; may be mechanical connection, and may also be electrical connection; and may be direct connection, and may also be indirect connection through an intermediate medium. For persons of ordinary skill in the art, specific meanings of the above terms in the present invention may be understood according to specific circumstances. Furthermore, in the description of the present invention, unless otherwise specified, "a plurality of" means two or more.

As shown in FIG. 1 to FIG. 7, a foldable recliner in Embodiment 1 comprises a supporting assembly, a backrest, a ground supporting component 3 and unfolding components 4, the backrest comprises backrest rods 6, the backrest rods 6 are hinged to the supporting assembly through first rotating shafts 1, the backrest rods 6 can be rotated between a sitting posture state and a lying posture state relative to the supporting assembly, the unfolding components 4 are fixedly connected to the backrest, first guide blind holes 22 and second guide blind holes 23 are formed in the unfolding components 4, two first guide grooves 9 that are in mirror symmetry are formed on two side surfaces of the unfolding components 4 along an extension direction of the first guide blind holes 22, two second guide grooves 10 that are in mirror symmetry are formed on two side surfaces of the unfolding components 4 along an extension direction of the second guide blind holes 23, the first guide grooves 9 and the second guide grooves 10 are distributed in an intersected mode, and terminal ends of the ground supporting component 3 are connected to the first guide grooves 9 and the second guide grooves 10 that are distributed in an intersected mode through connecting pins 5, and can move along a guide direction of the first guide grooves 9 or the second guide grooves 10. When the backrest is in the sitting posture state, the head of taller people cannot be supported because the backrest may not be high enough, the ground supporting component 3 is moved along the first guide grooves 9 and inserted into the first guide blind holes 22 to complete fixation, a height of the ground supporting component 3 is greater than that of the backrest, and the ground supporting component 3 is used as an extension of the backrest at this time, such that the height of the backrest of the recliner is increased, the head of a user is not suspended when leaning on the ground supporting component 3, and use experience of the user is improved. When the backrest is in the lying posture state, the ground supporting component 3 is moved along the second guide grooves 10 and inserted into the second guide blind holes 23 to complete fixation, such that the ground supporting component 3 is in contact with the ground to support the backrest. At this time, the ground supporting component 3 is used as a support for the backrest of the recliner to stabilize the recliner and improve the practicality and safety of the recliner.

As shown in FIG. 1 to FIG. 4, in Embodiment 1, the supporting assembly comprises first supporting legs 11, second supporting legs 12, a supporting frame 13 and a reinforcing beam 14, upper ends of the first supporting legs 11 are pivotally connected to upper ends of the second supporting legs 12, the supporting frame 13 is pivotally connected to the first supporting legs 11, two ends of the reinforcing beam 14 are fixedly connected to a rear end of the supporting frame 13, first hinge members 15 are hinged to the second supporting legs 12, U-shaped connecting sheets 16 are fixed on the rear end of the supporting frame 13, and end portions of the backrest rods 6 are embedded into opening portions of the U-shaped connecting sheets 16 and hinged to the U-shaped connecting sheets 16 and the first hinge members 15 through the first rotating shafts 1.

Figure 6:
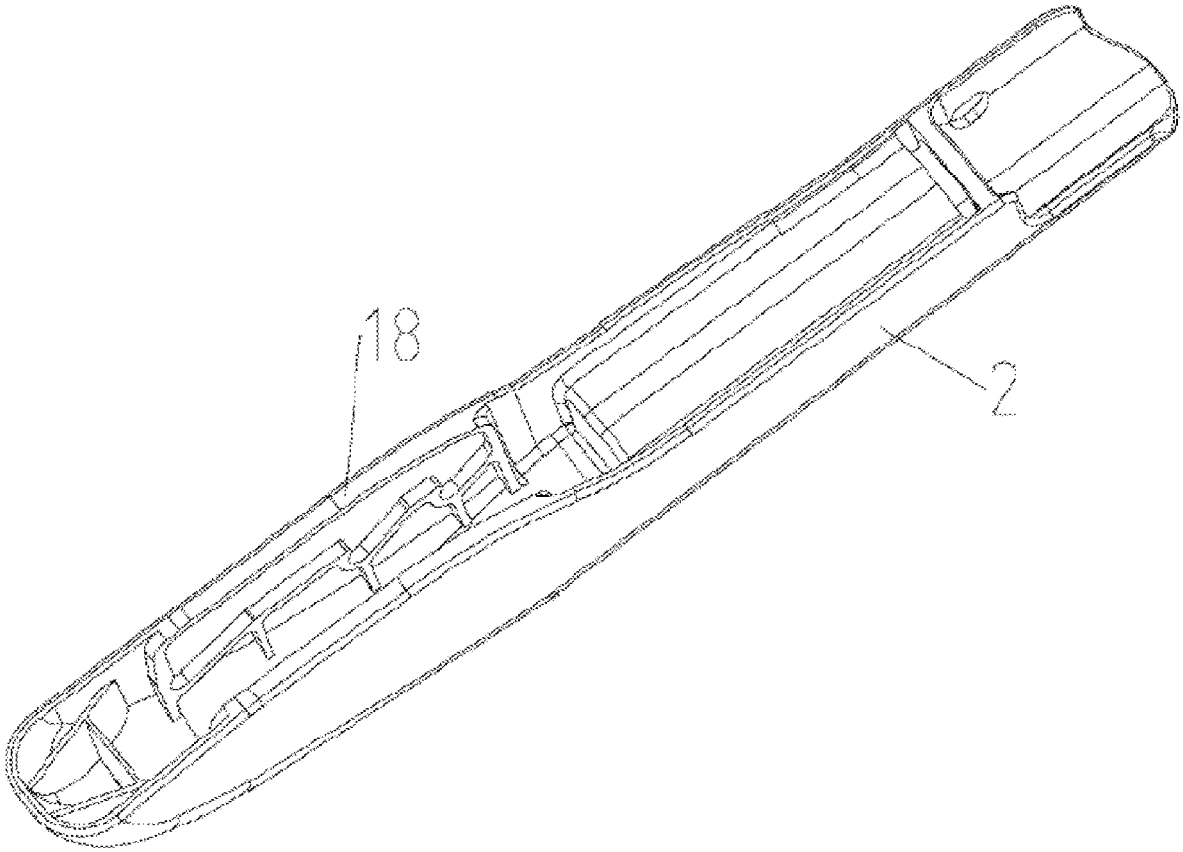
FIG. 6 is an internal structural schematic diagram of an armrest of the foldable recliner of the present invention in Embodiment 1.
Figure 7:
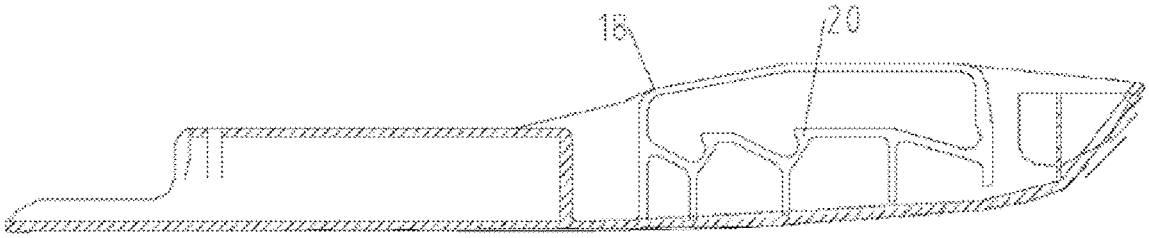
FIG. 7 is a section view of an armrest of the foldable recliner of the present invention in Embodiment 1.

As shown in FIG. 6 and FIG. 7, rear ends of armrests 2 are hinged to the backrest rods 6, protective covers 19 are formed on two sides of the armrests 2, lower ends of the armrests 2 are provided with two hanging portions 18, guide grooves are formed on the hanging portions 18, groove walls of the guide grooves are provided with a plurality of hooks 20, pivot joints of the upper ends of the first supporting legs 11 and the upper ends of the second supporting legs 12 are fixedly connected with connecting shafts 21, two ends of the connecting shafts 21 are sleeved in the two guide grooves, respectively, and by moving the connecting shafts 21 in the guide grooves, the different hooks 20 are hung on the connecting shafts 21. By hanging the hooks 20 on the connecting shafts 21, the backrest rods 6 are hinged to the armrests 2, and the backrest rods 6 are rotated relative to the supporting assembly. The connecting shafts 21 can be moved in the guide grooves by pushing and pulling the armrests 2 back and forth to adjust an angle of the backrest rods 6 relative to the supporting assembly so as to adjust the backrest rods between the sitting posture state and the lying posture state. After the angle is adjusted, the corresponding hooks 20 on the hanging portions 18 are hooked on the connecting shafts 21 to complete angle adjustment and fixation of the backrest of the recliner.

Figure 8:
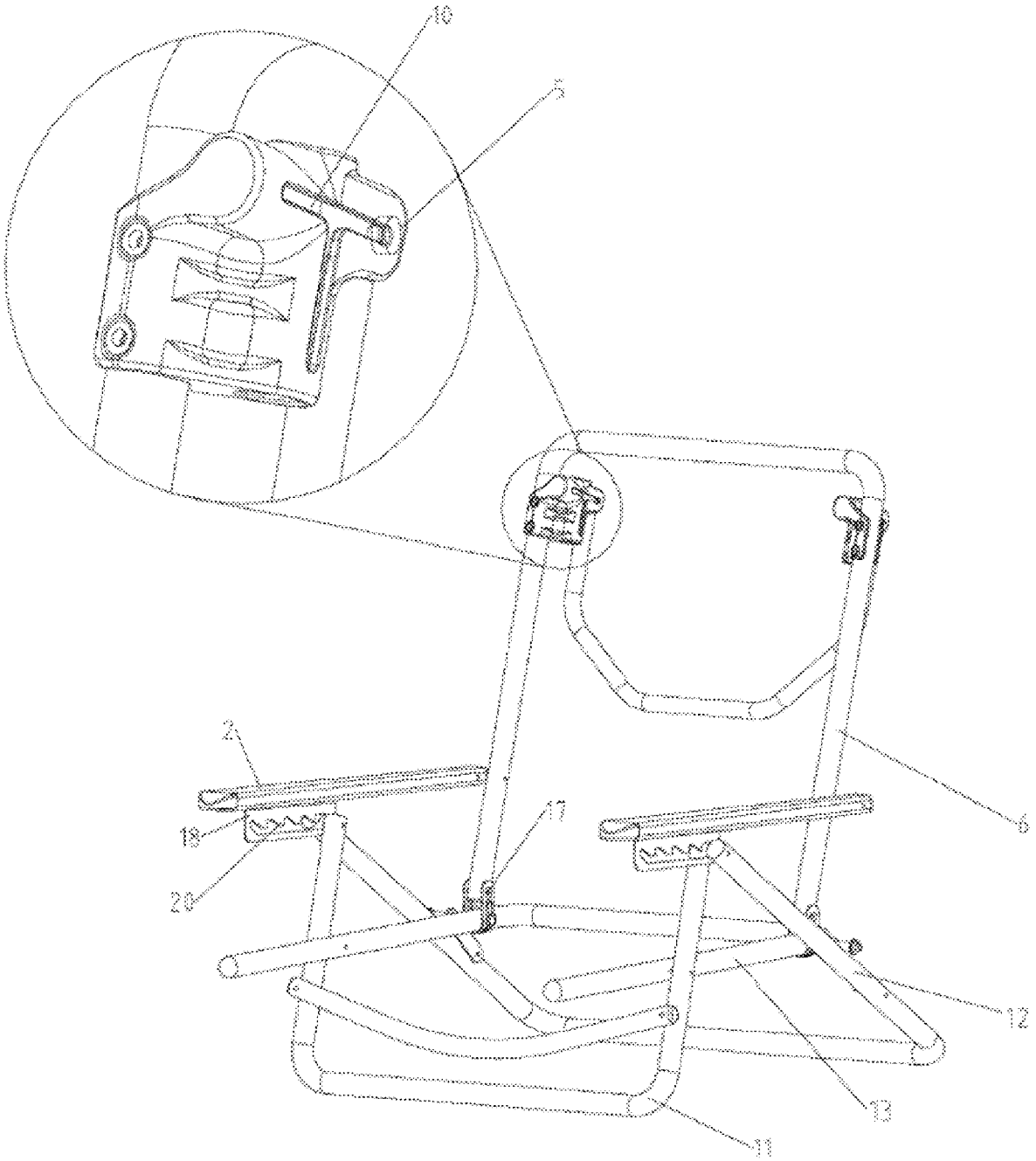
FIG. 8 is a structural schematic diagram of a foldable recliner of the present invention when a ground supporting component is folded in Embodiment 2.
Figure 9:
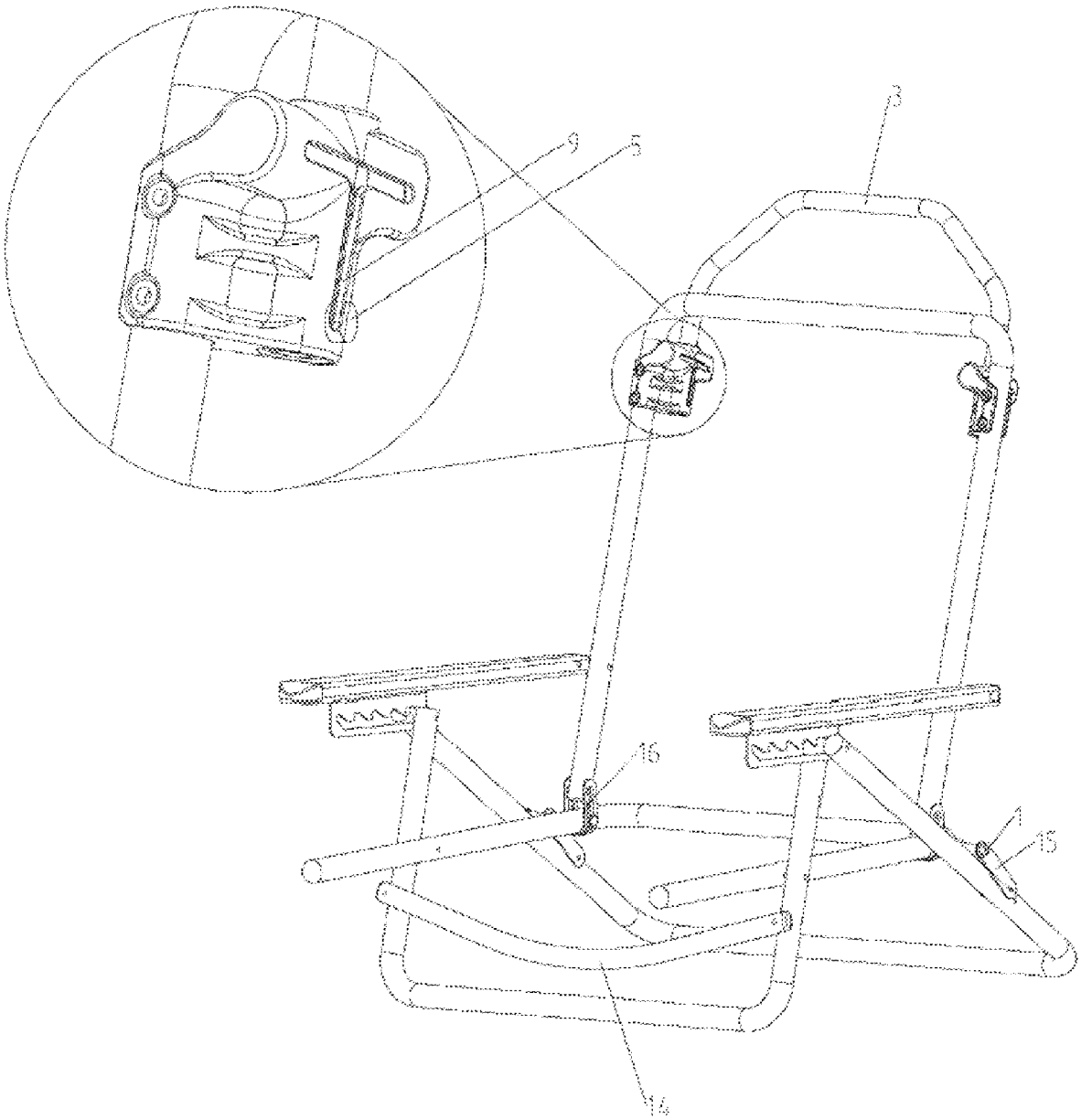
FIG. 9 is a structural schematic diagram of the foldable recliner of the present invention when a backrest is in a sitting posture state in Embodiment 2.
Figure 10:
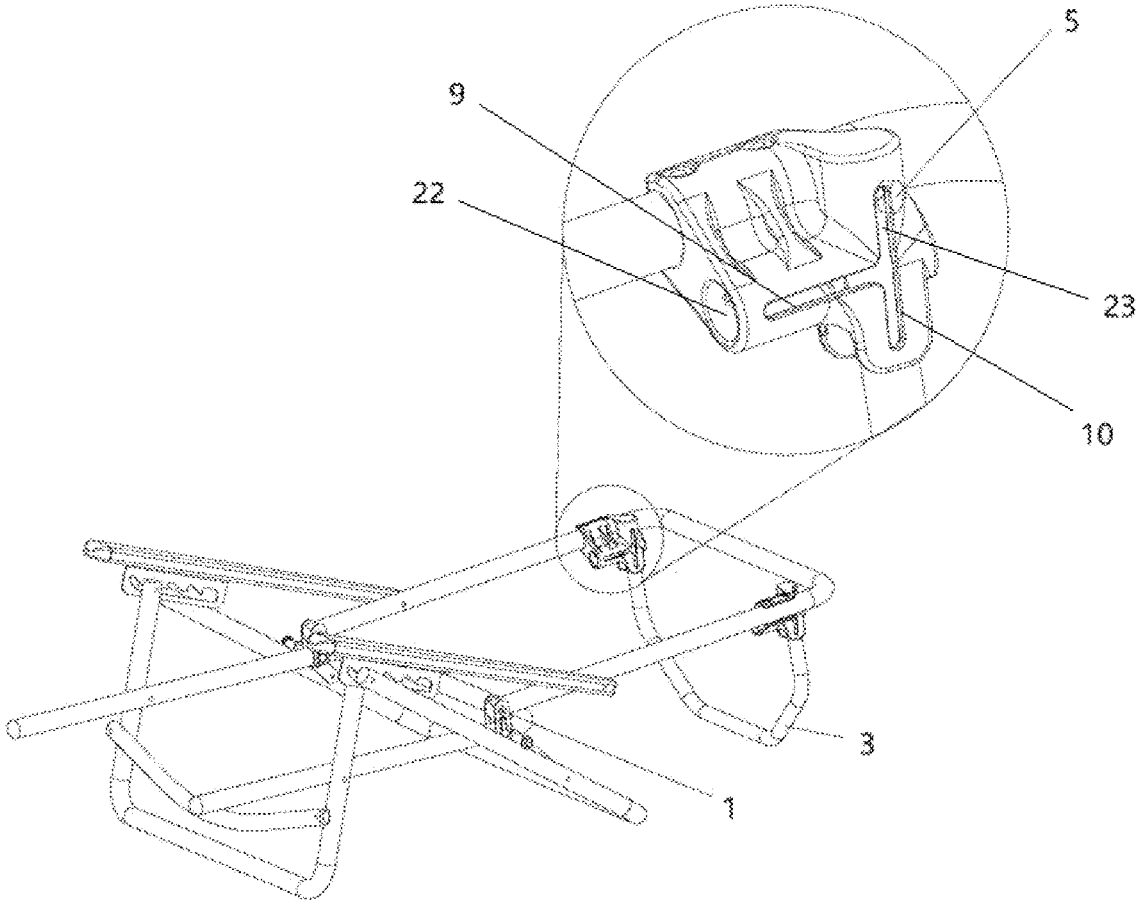
FIG. 10 is a structural schematic diagram of the foldable recliner of the present invention when the backrest is in a lying posture state in Embodiment 2.

As shown in FIG. 8 to FIG. 10, a foldable recliner in Embodiment 2 is different from Embodiment 1 in that the supporting assembly comprises first supporting legs 11, second supporting legs 12, a supporting frame 13 and a reinforcing beam 14, upper ends of the first supporting legs 11 are pivotally connected to upper ends of the second supporting legs 12, first hinge members 15 are hinged to the second supporting legs 12, U-shaped connecting sheets 16 are fixed on the supporting frame 13, the first hinge members 15 are hinged to the supporting frame 13 through the first rotating shafts 1, end portions of the backrest rods 6 are embedded into opening portions of the U-shaped connecting sheets 16 and hinged to the U-shaped connecting sheets 16 through second rotating shafts 17, the supporting frame 13 is hinged to the first supporting legs 11, and two ends of the reinforcing beam 14 are fixedly connected to the first supporting legs 11, respectively.

One of the first hinge members 15 in the above two embodiments is used to realize hinged connection between the backrest rods 6, the second supporting legs 12 and the supporting frame 13, and the other one of the first hinge members 15 is used to achieve a limiting effect. When the backrest rods 6 and the supporting frame 13 are rotated relative to the second supporting legs 12 and when the first hinge members 15 (Embodiment 1) or the first rotating shafts 1 (Embodiment 2) are connected to the second supporting legs 12, the backrest rods 6 are in a stable state relative to the supporting assembly, thereby enhancing the stability of the recliner itself.

As shown in FIG. 8 to FIG. 10, according to the foldable recliner in Embodiment 2, one ends of the armrests 2 are hinged to the backrest rods 6, lower ends of the armrests 2 are provided with hanging portions 18, guide grooves are formed on the hanging portions 18, groove walls of the guide grooves are provided with a plurality of hooks 20, gaps are remained between the first supporting legs 11 and the second supporting legs 12 when the first supporting legs 11 are pivotally connected to the second supporting legs 12, pivot shafts between the first supporting legs 11 and the second supporting legs 12 pass through the guide grooves, and by moving the pivot shafts in the guide grooves, the different hooks 20 are hung on the pivot shafts. The backrest rods 6 are hinged to the armrests 2, and lower ends of the backrest rods 6 are also pivotally connected to the second rotating shafts 17. An angle of the backrest rods 6 relative to the supporting assembly can be adjusted by pushing and pulling the armrests 2 back and forth.

After the angle is adjusted, the corresponding hooks 20 on the hanging portions 18 are hooked on the pivot shafts between the first supporting legs 11 and the second supporting legs 12 to complete angle adjustment and fixation of the backrest of the recliner.

Figure 11:
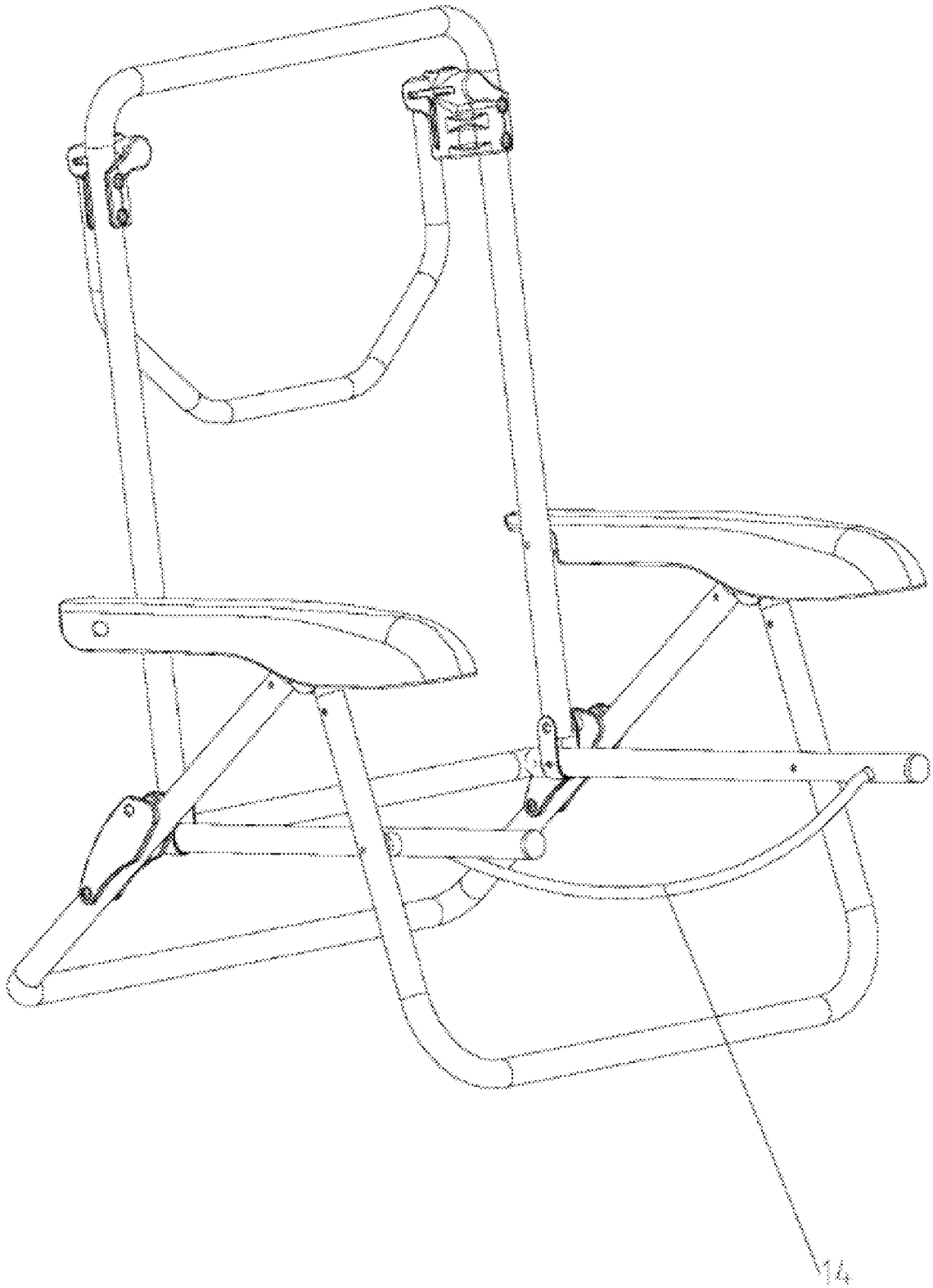
FIG. 11 is a structural schematic diagram of a foldable recliner of the present invention in Embodiment 3.

As shown in FIG. 11, Embodiment 3 of the foldable recliner is different from Embodiment 1 in that an opening of the supporting frame is more front, and the reinforcing beams 14 are connected to two front ends of the supporting frame.

In the description of the specification, the description with reference to the terms, such as "one embodiment", "some embodiments", "example", "specific example", or "some examples", etc., means that specific features, structures, materials, or characteristics that are described in conjunction with the embodiment or example are included in at least one embodiment or example of the present invention. In the specification, schematic statements of the terms do not necessarily refer to a same embodiment or example. Furthermore, the described specific features, structures, materials, or characteristics may be combined in a suitable manner in any one or more embodiments or examples.

Taking the above ideal embodiments of the present invention as inspiration, according to the above description of contents, relevant workers can make various changes and modifications without departing from the scope of the technical idea of the present invention. The technical scope of the present invention is not limited to the contents of the specification, and the technical scope needs to be determined according to the scope of the claims.

What is claimed is:

1. A foldable recliner, comprising a supporting assembly and a backrest, wherein the backrest is hinged to the supporting assembly through first rotating shafts, and the backrest can be rotated between a sitting posture state and a lying posture state relative to the supporting assembly; characterized in that the foldable recliner further comprises a ground supporting component and unfolding components, wherein the unfolding components are fixedly connected to the backrest, and first guide blind holes and second guide blind holes are formed in the unfolding components; when the backrest is in the sitting posture state, the ground supporting component is inserted into the first guide blind holes, and a height of the ground supporting component is greater than that of the backrest; and when the backrest is in the lying posture state, the ground supporting component is inserted into the second guide blind holes, such that the ground supporting component is in contact with the ground to support the backrest.

2. The foldable recliner according to claim 1, characterized in that the backrest comprises backrest rods, two first guide grooves that are in mirror symmetry are formed on two side surfaces of the unfolding components along an extension direction of the first guide blind holes, two second guide grooves that are in mirror symmetry are formed on two side surfaces of the unfolding components along an extension direction of the second guide blind holes, the first guide grooves and the second guide grooves are distributed in an intersected mode, and terminal ends of the ground supporting component are connected to the first guide grooves and the second guide grooves that are distributed in the intersected mode through connecting pins, and can move along a guide direction of the first guide grooves or the second guide grooves.

3. The foldable recliner according to claim 2, characterized in that the supporting assembly comprises first supporting legs, second supporting legs, a supporting frame and a reinforcing beam, upper ends of the first supporting legs are pivotally connected to upper ends of the second supporting legs, first hinge members are hinged to the second supporting legs, U-shaped connecting sheets are fixed on a rear end of the supporting frame, end portions of the backrest rods are embedded into opening portions of the U-shaped connecting sheets and hinged to the U-shaped connecting sheets and the first hinge members through the first rotating shafts, the supporting frame is pivotally connected to the first supporting legs, and two ends of the reinforcing beam are fixedly connected to the rear end of the supporting frame.

4. The foldable recliner according to claim 3, characterized in that the foldable recliner further comprises armrests, wherein rear ends of the armrests are hinged to the backrest rods, lower ends of the armrests are provided with two hanging portions, guide grooves are formed on the hanging portions, groove walls of the guide grooves are provided with a plurality of hooks, pivot joints of the upper ends of the first supporting legs and the upper ends of the second supporting legs are fixedly connected with connecting shafts, two ends of the connecting shafts are sleeved in the two guide grooves, respectively, and by moving the connecting shafts in the guide grooves, the different hooks are hung on the connecting shafts.

5. The foldable recliner according to claim 2, characterized in that the supporting assembly comprises first supporting legs, second supporting legs, a supporting frame and a reinforcing beam, upper ends of the first supporting legs are pivotally connected to upper ends of the second supporting legs, first hinge members are hinged to the second supporting legs, U-shaped connecting sheets are fixed on the supporting frame, the first hinge members are hinged to the supporting frame through the first rotating shafts, lower portions of the backrest rods are embedded into opening portions of the U-shaped connecting sheets and hinged to the U-shaped connecting sheets through second rotating shafts, the supporting frame is hinged to the first supporting legs, and two ends of the reinforcing beam are connected to the first supporting legs.

6. The foldable recliner according to claim 5, characterized in that the foldable recliner further comprises armrests, wherein rear ends of the armrests are hinged to the backrest rods, lower ends of the armrests are provided with hanging portions, guide grooves are formed on the hanging portions, groove walls of the guide grooves are provided with a plurality of hooks, gaps are remained between the first supporting legs and the second supporting legs when the first supporting legs are hinged to the second supporting legs, pivot shafts between the first supporting legs and the second supporting legs pass through the guide grooves, and by moving the pivot shafts in the guide grooves, the different hooks are hung on the pivot shafts.

* * * * *